US005950459A

United States Patent [19]

Takagi et al.

[11] Patent Number: 5,950,459

[45] Date of Patent: Sep. 14, 1999

[54] ELECTRIC WASHING MACHINE INCLUDING WASHING TANK AND AGITATOR WHICH ROTATE IN OPPOSITE DIRECTIONS

[75] Inventors: Shinya Takagi; Akira Yoshida; Masafumi Satomura, all of Nara, Japan

[73] Assignee: Sharp Kabushiki Kaisha, Osaka, Japan

[21] Appl. No.: 08/961,429

[22] Filed: Oct. 30, 1997

[30] Foreign Application Priority Data

Oct. 31, 1996 [JP] Japan ..... 8-289852

[51] Int. Cl.[6] ..... D06F 21/08

[52] U.S. Cl. ..... 68/23.6; 68/53; 68/134; 68/174

[58] Field of Search ..... 68/23.6, 53, 54, 68/134, 171, 174

[56] References Cited

U.S. PATENT DOCUMENTS

| | | | |
|---|---|---|---|
| 2,986,916 | 6/1961 | Bochan | 68/171 X |
| 4,835,994 | 6/1989 | Ishida et al. | 68/174 |
| 5,353,612 | 10/1994 | Noguchi et al. | 68/12.02 |
| 5,661,990 | 9/1997 | Chong | 68/23.6 |

FOREIGN PATENT DOCUMENTS 59-228892 12/1984 Japan .

*Primary Examiner*—Philip R. Coe

[57] ABSTRACT

An electric washing machine includes a washing machine body, a water tank fixed in the washing machine body and having an opening at the bottom, a double-cylindrical axis body formed of outer and inner rotary axes passing through the opening in the water tank, a washing tank in the water tank attached to the upper end of the outer rotary axis, with a large number of dehydration holes, a container type agitator attached to the upper end of the inner rotary axis, arranged at the bottom of the washing tank, and a planetary gear mechanism coupled to the lower end of the double-cylindrical axis body. The planetary gear mechanism includes an input axis, a planetary gear outer periphery portion fixed to the outer rotary axis, and a planetary gears coupled to the inner rotary axis and engaging with the outer periphery of the input axis and the inner surface of the planetary gear outer periphery portion. The washing machine further includes an electric motor and power transmission mechanism, and a brake arranged near the planetary gear outer periphery portion, releasing the planetary gear outer periphery portion at least during washing, and clamping the planetary gear outer periphery portion during dehydration. Preferably, the agitator has a liquid passing hole formed at the bottom. More preferably, the electric washing machine further includes convex portions provided on the bottom surface of the container type agitator.

20 Claims, 7 Drawing Sheets

ELECTRIC WASHING MACHINE INCLUDING WASHING TANK AND AGITATOR WHICH ROTATE IN OPPOSITE DIRECTIONS

BACKGROUND OF THE INVENTION

1. Field of the Invention

The present invention relates to an electric washing machine and more particularly to an electric washing machine which has a container type agitator with a plurality of convex portions formed on its inner surface and which can prevent damage to the laundry by agitating the laundry with the agitator and carry out washing efficiently.

2. Description of the Related Art

A conventional electric washing machine agitates the laundry by its pulsator. However, if there is less laundry, the pulsator may rotate excessively and cause damage to the laundry. On the other hand, when the amount of the laundry is large, the area of the pulsator which comes into contact with the laundry is small, and the pulsator rotates while hitting the laundry. Therefore, the laundry is damaged in this operation as well.

In order to address this problem, Japanese Patent Laying-Open No. 59-228892 discloses a washing machine which has a container type agitator provided in a washing tank. However, the washing machine disclosed in the publication only washes the laundry by rotating the container type agitator. Therefore, all pieces of the laundry which are at the bottom and top of the agitator cannot fully be washed unless the rotation of the agitator is increased. Further, at the time of washing and rinsing, water remains at the bottom of the agitator in this described washing machine. Since the water is not exchanged completely, washing, rinsing and/or dehydration have been unsatisfactory. In addition, the laundry may be jammed between the agitator and its peripheral fixed wall portion in this washing machine, and this may make the washing machine inoperable.

SUMMARY OF THE INVENTION

Therefore, an object of the present invention is to provide an electric washing machine which allows uniform washing of the laundry by a container type agitator.

Another object of the present invention is to provide an electric washing machine which allows uniform washing of the laundry while much less damaging the laundry by a container type agitator.

Yet another object of the present invention is to provide a washing machine which allows uniform washing of the laundry by a container type agitator and its full dehydration.

An additional object of the present invention is to provide a washing machine which allows uniform washing of the laundry by a container type agitator operating smoothly at the time of washing.

An electric washing machine according to the present invention includes a washing machine body, a water tank fixed in the washing machine body and having an opening at the bottom, a double-cylindrical axis body formed of outer and inner rotary axes passing through the opening of the water tank bottom surface, a washing tank attached to the upper end of the outer rotary axis, arranged in the water tank, and having a large number of dehydration holes through the sidewall, a container type agitator attached to the upper end of the inner rotary axis, arranged at the bottom of the washing tank, and having a shape which is open upward, and a planetary gear mechanism coupled to the lower end of the double-cylindrical axis body. The planetary gear mechanism includes an input axis, a planetary gear outer periphery portion fixed to the outer rotary axis, and a group of planetary gears coupled to the inner rotary axis, engaging with the outer periphery of the input axis and the inner surface of the planetary gear outer periphery portion, and rotating in a group around the input axis. The washing machine further includes an electric motor and power transmission mechanism for rotatably driving the input axis, and a break arranged near the outer periphery of the planetary gear outer periphery portion, releasing the planetary gear outer periphery portion at least at the time of washing, and clamping the planetary gear outer periphery portion at the time of dehydration.

During washing, the planetary gear outer periphery portion is released to rotate the input axis of the planetary gear mechanism. The inner rotary axis and the container type agitator which is at its end are rotated through the planetary gear mechanism in the same direction as the rotational direction of the input axis. A load of the laundry causes reaction to the container type agitator. The reaction adds torque to the planetary gear outer periphery portion in the direction opposite to the rotational direction of the inner rotary axis. Since the break has released the planetary gear outer periphery portion, the planetary gear outer periphery portion, the outer rotary axis fixed to the planetary gear outer periphery portion, and the washing tank fixed to the outer rotary axis rotate in the direction opposite to the rotational direction of the container type agitator. Since the laundry is rubbed and twisted by the container type agitator and the washing tank which rotate in opposite directions, dirt is efficiently removed even if the container type agitator is not rotated at high speed. Further, by the use of the container type agitator, the laundry is caught against a larger area as compared with the case of a pulsator. Therefore, damage caused to the laundry is minor.

In a preferred embodiment, the container type agitator of the electric washing machine has a liquid passing hole formed through the bottom. In dehydration, washing liquid in the container type agitator is completely discharged through this liquid passing hole. Thus, no water remains in the container type agitator and it enables efficient dehydration and rinsing.

More preferably, the electric washing machine further includes a convex portion provided on the bottom surface of the container type agitator. The convex portion may be formed spirally on the bottom surface of the container type agitator. Further, the convex portion may be arranged on the bottom surface of the container type agitator so that its longitudinal direction forms a prescribed angle other than zero with the horizontal surface. Because of the convex portion, the laundry is better caught by the container type agitator. Since the laundry is substantially rubbed and twisted between the container type agitator and the washing tank, the washing effect can be improved. Further, if a spiral convex portion is used, the laundry moves smoothly on the agitator and it enables more efficient washing.

In another aspect of the present invention, the washing machine may further include a jamming preventing hopper fixed in the inner surface of the washing tank immediately over the container type agitator. The hopper is formed of an annular frame body having an almost inverted trapezoid cross section which has an upper opening having the almost same size as the planar shape of the washing tank and a lower opening having a smaller size. The hopper is fixed to the inner surface of the washing tank so that its lower opening is under the upper rim of the container type agitator.

The electric washing machine may further include a plurality of abutting projections arranged in positions opposing an oblique side surface of the hopper in the vicinity of the upper rim of the bottom surface of the container type agitator.

Provision of the hopper reduces the likelihood that the laundry and lint are jammed in a gap between the lower surface of the container type agitator and the bottom surface of the washing tank. Therefore, the washing can be performed more efficiently and damage to the laundry can be prevented.

The electric washing machine may further include, on the lower surface of the container type agitator, a water pressurizing blade formed to a size not interfering with the bottom surface of the washing tank. Water in the gap between the lower surface of the container type agitator and the bottom surface of the washing tank is forcibly returned inside the container type agitator through the gap between the hopper and container type agitator. Therefore, it becomes less likely that the laundry and lint are jammed between the lower surface of the container type agitator and the bottom surface of the washing tank and between the hopper and container type agitator. Therefore, washing can be performed more efficiently.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
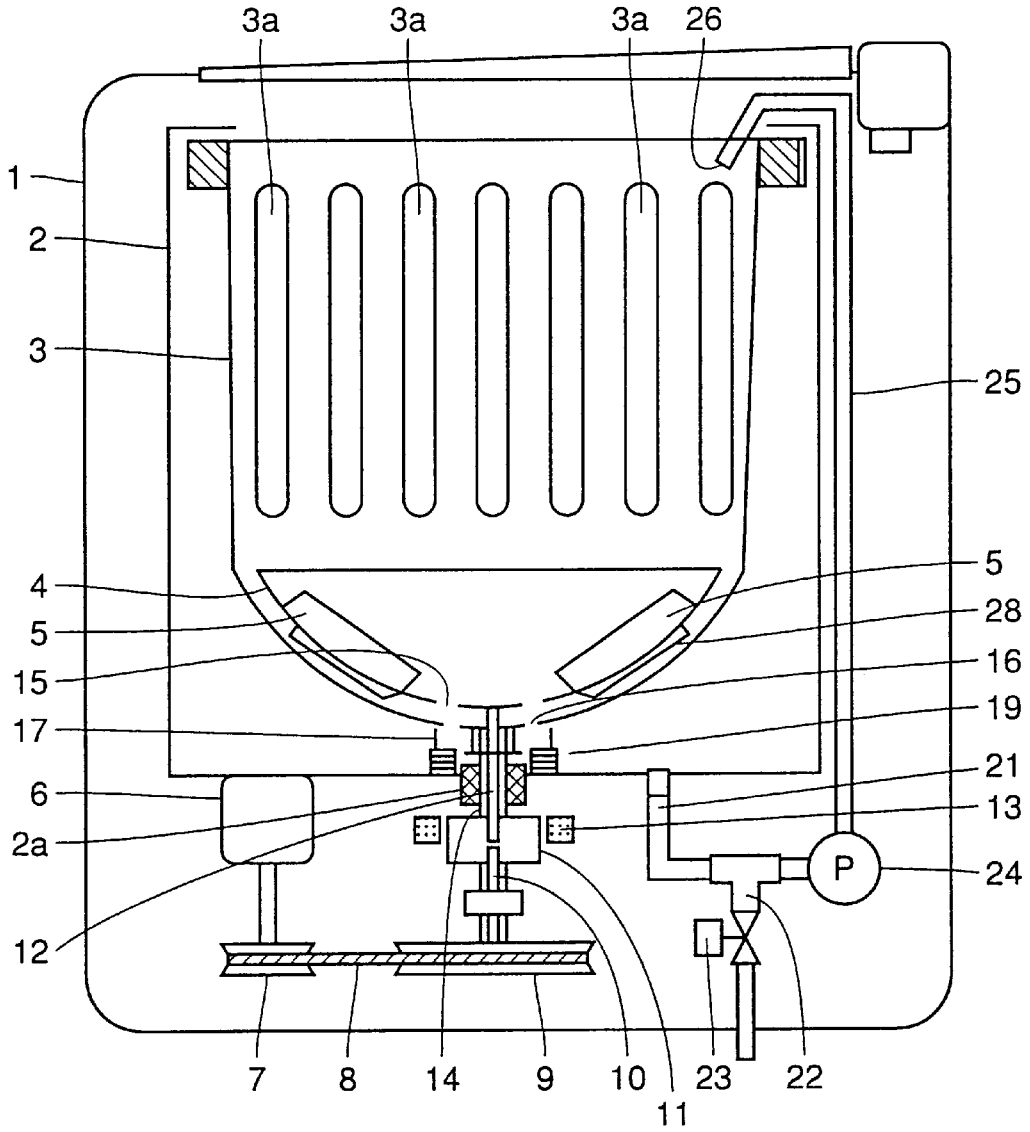
FIG. 1 is a front sectional view showing a schematic structure of an electric washing machine according to a first embodiment of the present invention.

Referring to FIG. 1, an electric washing machine according to a first embodiment of the present invention includes a washing machine body 1, a water tank 2 suspended and supported by a suspending device, not shown, in washing machine body 1, a washing tank 3 rotatably provided in water tank 2, and a container type agitator 4 provided at the lower portion inside washing tank 3 and having a curved surface such as a hemispherical shell or cycloid which is open upward above.

In washing tank 3, a plurality of projections 3*a* are formed on an inner wall portion not corresponding to container type agitator 4. Projections 3*a* have a rectangular planar shape extending in the vertical direction in this embodiment and having rounded corners of a few millimeters in height. A large number of projections 3*a* are provided at regular intervals along the circumferential direction. Through sidewall of washing tank 3, a large number of dehydration holes are formed, which are not shown.

It is easily recognized that the shape of projection 3*a* is not limited to the one shown in FIG. 1. Projection 3*a* may be of any shape as far as it causes friction between the laundry and washing tank 3 and it does not cause damage to the laundry.

Figure 2:
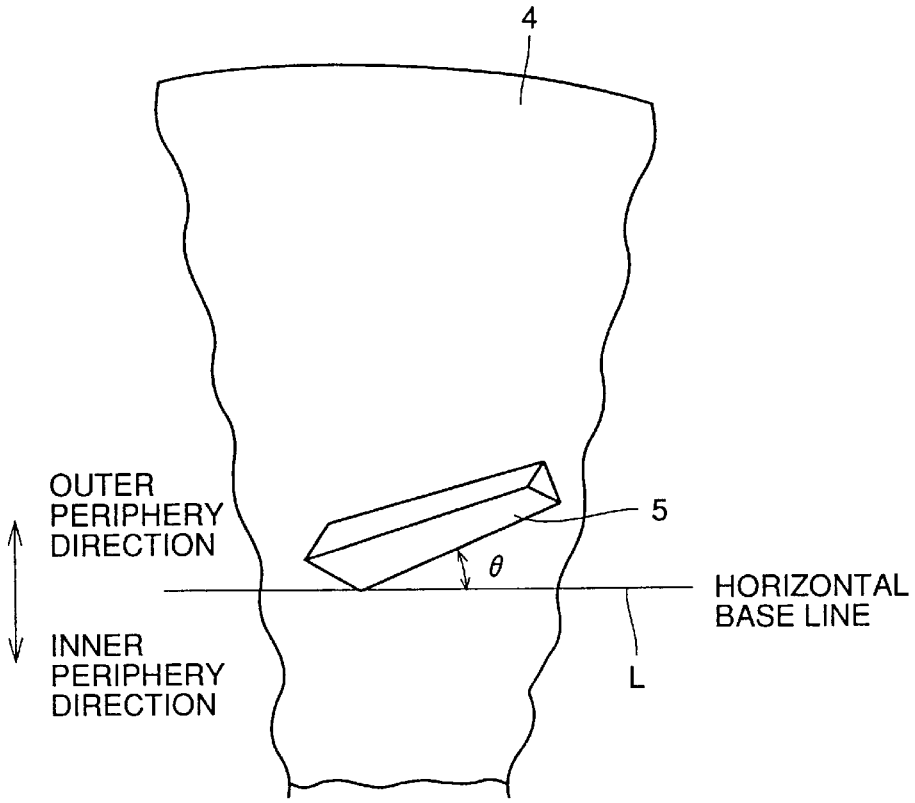
FIG. 2 is an enlarged view showing a main part of a container type agitator of the electric washing machine in the first embodiment of the present invention.

On the inner wall surface, container type agitator 4 has a plurality of convex portions 5 arranged at regular intervals in the circumferential direction. Referring to FIG. 2, convex portions 5 are arranged inclined upward by a certain angle θ with respect to a horizontal line L, on the bottom surface agitator 4. The degree of washing depends on the angle θ. The result will be described below with reference to FIG. 5. Agitator 4 has a plurality of water pressurizing blades 28 provided half way up the lower surface and pushing up water between agitator 4 and washing tank 3 by the rotation of agitator 4 and washing tank 3.

Referring again to FIG. 1, agitator 4 has a plurality of liquid passing holes 15 formed around the center of the bottom. The bottom of washing tank 3 has a shape which conforms to the bottom shape of agitator 4. Through the bottom surface, a plurality of liquid passing holes 16 are formed in positions corresponding to liquid passing holes 15.

The washing machine further includes a receiving dish 17 provided on the bottom surface of washing tank 2 for receiving washing liquid discharged through liquid passing holes 15 and 16, and a height adjusting device 19 for attaching receiving dish 17 movable upward and downward on the bottom surface of water tank 2. Details of the structure of receiving dish 17 will be described below with reference to FIG. 3.

Referring to FIG. 1, the washing machine further includes: a drive motor 6 fixedly provided at the bottom of water tank 2; a small pulley 7 fixed to a tip of the rotary axis of drive motor 6; an inner rotary axis 12 fixed to the center of the bottom surface of agitator 4 and arranged to penetrate the bottom surface center portion of washing tank 3 and water tank 2 for driving agitator 4; a belt 8, a large pulley 9, a rotation transmission axis 10 and a planetary gear mechanism 11 for transferring the rotation of small pulley 7 to inner rotary axis 12; a brake 13 provided at the outer periphery of planetary gear mechanism 11; and an outer rotary axis 14 attached and coupled to planetary gear mechanism 11, housing inner rotary axis 12 inside, and attached to washing tank 3 at the tip. As shown in FIG. 1, inner rotary axis 12 is arranged inside outer rotary axis 14, and these axes constitute a double-cylindrical axis body. In addition, a water seal bearing 12*a* is provided in a hole at the bottom of water tank 2 into which outer rotary axis 14 is inserted.

The washing machine further includes a drain pipe 21 introduced from the bottom of water tank 2, a flow dividing tube 22 provided at a tip of drain pipe 21, a drain electromagnetic valve 23 provided at one end of flow dividing tube 22, a return pipe 25 connected to the other end of flow dividing tube 22, and a circulation pump 24 provided in return pipe 25. Return pipe 25 extends along the peripheral sidewall of water tank 2 and its tip is higher than the upper rim of water tank 2. The tip is bent toward the upper surface of water tank 2, and an injection nozzle 26 is attached to the tip.

Figure 3:
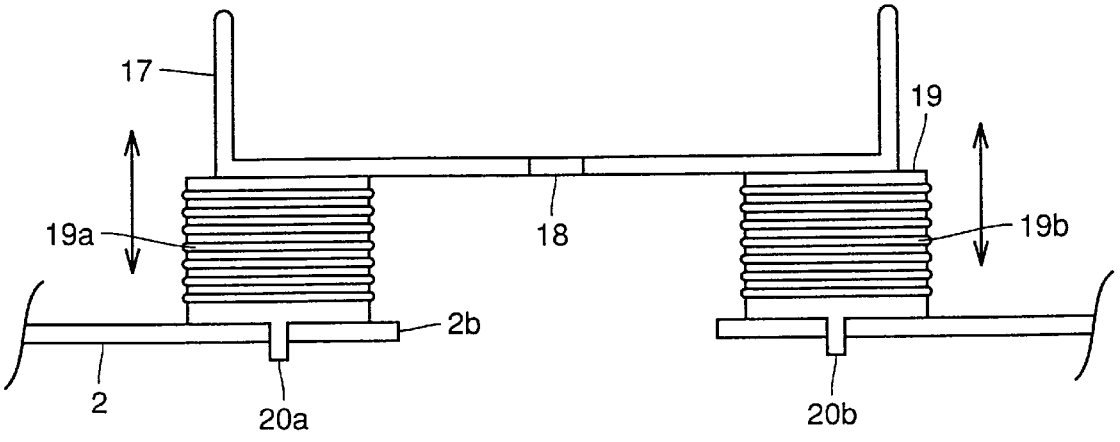
FIG. 3 is an enlarged sectional view showing a liquid receiving dish and an angle adjusting device.

Referring to FIG. 3, receiving dish 17 is attached on the bottom surface of water tank 2 as described below. An opening 2*b* is formed at the bottom surface of water tank 2. A height adjusting device 19 is provided around and above opening 2*b* at a position not interfering with water seal bearing 2*a*. At the bottom surface, receiving dish 17 has a hole 18 through which outer rotary axis 14 passes. Receiving dish 17 is attached at the top of height adjusting device 19 so that hole 18 is situated on the center of opening 2*b*.

Height adjusting device 19 includes a pair of left and right metal bellows 19*a* and 19*b*. Metal bellows 19*a* and 19*b* have at their bottoms pressurizing pipes 20*a* and 20*b* connected to an air pump or water supply pump which is not shown, respectively. Metal bellows 19*a* and 19*b* are extended by pressurized air or pressurized water supplied from respective pressurizing pipes 20*a* and 20*b*. When metal bellows 19*a* and 19*b* are extended sufficiently, the top surface of receiving dish 17 is pushed against the bottom surface of washing tank 3 with a packing interposed, not shown, which is provided at the bottom surface of washing tank 3, and thus liquid passing hole 16 of washing tank 3 is closed. The amount of washing liquid leakage from washing tank 3 can arbitrary be adjusted by the magnitude of air pressure or water pressure on metal bellows 19*a* and 19*b*. Here, when the air pressure or water pressure to metal bellows 19*a* and 19*b* is small, receiving dish 17 moves downward by its own weight.

Figure 4:
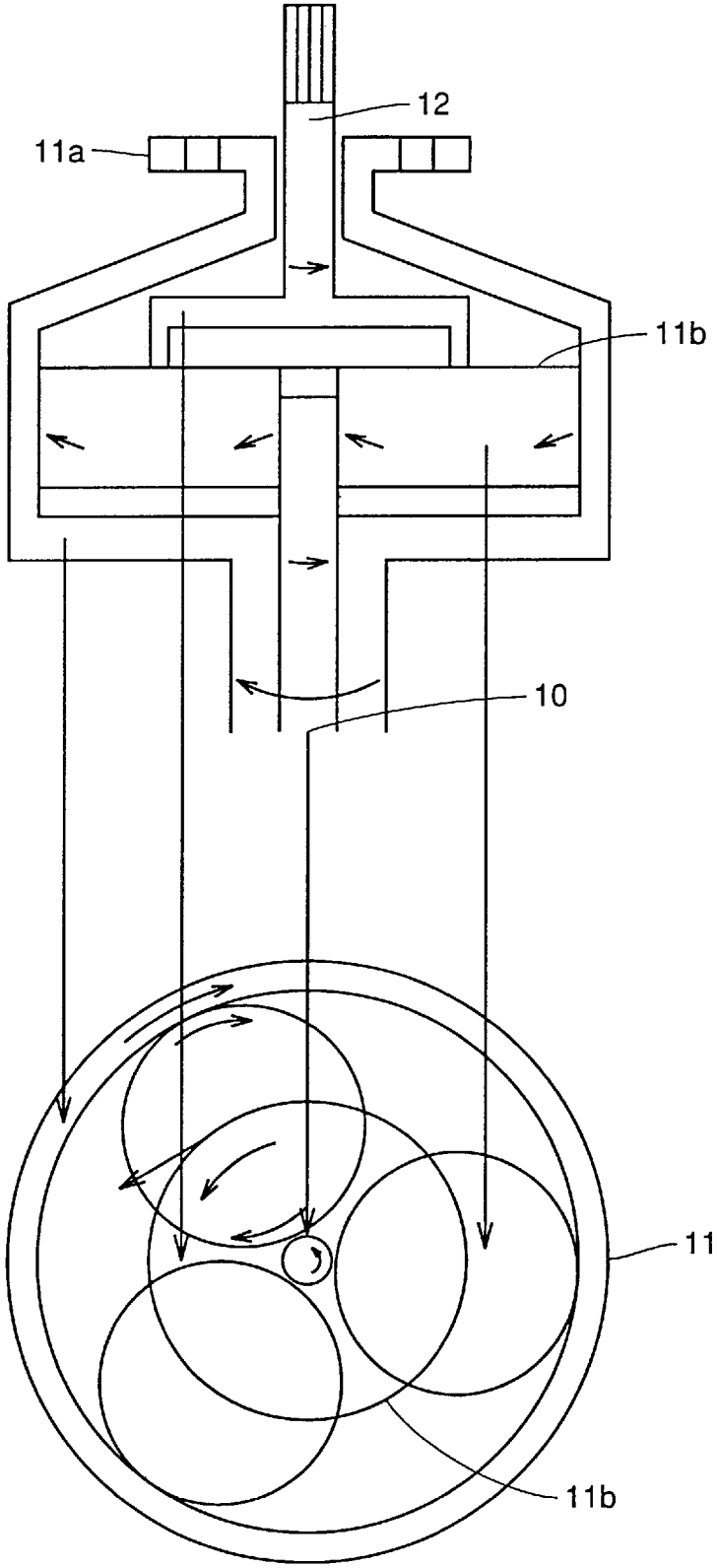
FIG. 4 schematically shows a planetary gear mechanism.

Referring to FIG. 4, planetary gear mechanism 11 includes a planetary gear outer periphery portion 11*a*, and a planetary gear 11*b* coupled to inner rotary axis 12, engaging with the outer periphery of rotation transmission axis 10 on the inside, and engaging with the inner periphery of planetary gear outer periphery portion 11*a* on the outside. As shown in FIG. 1, the outer periphery of planetary gear mechanism 11 is provided with brake 13 for clamping or releasing planetary gear outer periphery portion 11*a*.

When brake 13 is released, planetary gear outer periphery portion 11*a* attains the released state. When rotation transmission axis 10 which is an input axis is rotated by drive motor 6, the rotation is decelerated by planetary gear 11*b* and transferred to an output axis (inner rotary axis 12). Further, agitator 4 coupled to inner rotary axis 12 rotates in the same direction as the rotational direction of the input axis. If a load of water, the laundry or the like is imposed on agitator 4, the load causes reaction which applies torque to planetary gear outer periphery portion 11*a*. Since planetary gear outer periphery portion 11*a* is at the released state, it rotates in the direction opposite to the rotational direction of agitator 4 because of the reaction. Since washing tank 3 is coupled to planetary gear outer periphery portion 11*a* through outer rotary axis 14, washing tank 3 also rotates in the direction opposite to the rotation of agitator 4.

When brake 13 clamps planetary gear outer periphery portion 11*a*, planetary gear outer periphery portion 11*a* is fixed to the output axis. Therefore, washing tank 3 which is coupled to planetary gear outer periphery portion 11*a* through outer rotary axis 14 rotates at the same time and in the same direction as agitator 4.

The operation of the electric washing machine in the first embodiment will be described below with respect to its washing process, rinsing process and dehydration process in this order.

Washing Process

The laundry is put into washing tank 3. A power supply switch is turned on. The air pump or water supply pump (not shown) is activated to supply pressurized air or pressurized water through pressurizing pipes 20*a* and 20*b* to metal bellows 19*a* and 19*b*, respectively. Metal bellows 19*a* and 19*b* are extended, and washing liquid receiving dish 17 is pushed against the bottom surface of washing tank 3 through the packing which is not shown. Liquid passing hole 16 of washing tank 3 is closed.

A wash start button (not shown) is turned on. At timing at which liquid passing hole 16 is closed, a water supply electromagnetic valve, not shown, is turned on to start water supply to washing tank 3. When the water level in washing tank 3 reaches a prescribed level, a water level detector (not shown) operates to stop driving of the air pump and water supply pump. When pressurization on metal bellows 19*a* and 19*b* is stopped, receiving dish 17 moves downward by its own weight and thus liquid passing hole 16 is opened.

Washing water (with detergent) which is supplied to washing tank 3 flows from washing tank 3 to water tank 2 through liquid passing holes 15 and 16. At this time, drain electromagnetic valve 23 is closed, and circulation pump 24 is activated at the same time. The washing water flowing to water tank 2 is sucked from washing tank 2 through drain pipe 21 by suction of circulation pump 24. Further, the washing water flows through return pipe 25 and is injected from injection nozzle 26 to the laundry inside washing tank 3.

Simultaneously with driving of circulation pump 24, drive motor 6 is also activated. The driving force of the rotary axis of drive motor 6 is transferred through small pulley 7, belt 8, large pulley 9, rotation transmission axis 10, planetary gear mechanism 11 and inner rotary axis 12 to agitator 4 so as to rotate agitator 4. At this time, brake 13 is adapted to release planetary gear mechanism 11. Washing tank 3 rotates in the opposite direction to the rotation of agitator 4 by the reaction caused by the laundry and washing water.

Since the washing machine operates in this manner in the washing process, container type agitator 4 can catch the laundry against its entire body because of convex portions 5 of container type agitator 4. As compared with a conventionally used pulsator, the area for catching the laundry is increased. Since there is no pulsator which hits clothes, damage to the laundry is suppressed.

In the washing process, convex portions 5 which are provided on agitator 4 and projections 3*a* which are provided on washing tank 3 rotate in opposite directions. Therefore, pieces of the laundry are twisted and rubbed against each other. Dirt left in a fiber of the laundry is removed to the washing water. Since container type agitator 4 alternates its rotational direction at this time, damage to the laundry can be suppressed.

Further, as agitator 4 rotates, water pressurizing blades 28 push up water between washing tank 3 and agitator 4 upward. Since the water is forcibly discharged from a gap between agitator 4 and washing tank 3, this can prevent the laundry, lint or the like from jamming in the gap.

When the washing process is finished, drive motor 6 and circulation pump 24 are stopped. Drain electromagnetic valve 23 is opened to discharge the washing water from washing tank 3. Since liquid passing holes 15 and 16 are provided at the bottoms of agitator 4 and washing tank 3, respectively, as shown in FIG. 1, the washing water does not remain inside agitator 4 and washing tank 3 at this time. The water is completely discharged from agitator 4 and washing tank 3, and this will not affect subsequent rinsing.

Rinsing Process

When the discharge of the washing water is completed at the end of the washing process, the rinsing process is started. Washing liquid receiving dish 17 has been separated from the bottom surface of washing tank 3. Drain electromagnetic valve 23 is closed. The water supply electromagnetic valve is turned on to start water supply. When a prescribed amount of water is stored in water tank 2, drain electromagnetic valve 23 is opened while water is supplied, and drive motor 6 is activated. Similarly to the washing process, container type agitator 4 rotates clockwise and counterclockwise, and washing tank 3 accordingly rotates in opposite directions. At the same time, circulation pump 24 is turned on. Water is circulated through the path of washing tank 3, drain pipe 21, return pipe 25 and injection nozzle 26. Since the water is injected from injection nozzle 26 to the laundry, the rinsing effect is improved.

Dehydration Process

At the end of the rinsing process, the dehydration process is started. Drive motor 6 and circulation pump 24 are stopped. Drain electromagnetic valve 23 is opened to discharge the washing water from washing tank 3. At this time, rinsing water flows from liquid passing holes 15 and 16, and thus the washing water does not remain in agitator 4 and washing tank 3. Since the water is completely discharged from agitator 4, it will not affect succeeding dehydration.

When drainage is completed, drain electromagnetic valve 23 is kept open and planetary gear outer periphery portion 11*a* is clamped by brake 13. Drive motor 6 is activated to rotate its rotary axis in a certain direction. Brake 13 couples planetary gear mechanism 11 and outer rotary axis 14. Washing tank 3 coupled to outer rotary axis 14 and agitator 4 coupled to inner rotary axis 12 rotate at high speed in the same direction. Water in the laundry is squeezed out of the laundry by centrifugal force and discharged from the dehydration holes provided through the sidewall of washing tank 3.

According to the electric washing machine described above, the laundry is caught against a larger area of container type agitator 4 and therefore damage to the laundry is reduced. In the washing and rinsing processes, agitator 4 rotates clockwise and counterclockwise and washing tank 3 rotates in the directions opposite to the rotation of agitator 4. Further, convex portions 5 are provided on the inner surface of agitator 4 and a plurality of projections 3*a* are provided on the inner surface of washing tank 3. They increase friction against the laundry. Since pieces of the laundry are twisted and rubbed against each other between washing tank 3 and agitator 4 which rotate in opposite directions, dirt is efficiently removed.

Figure 5:
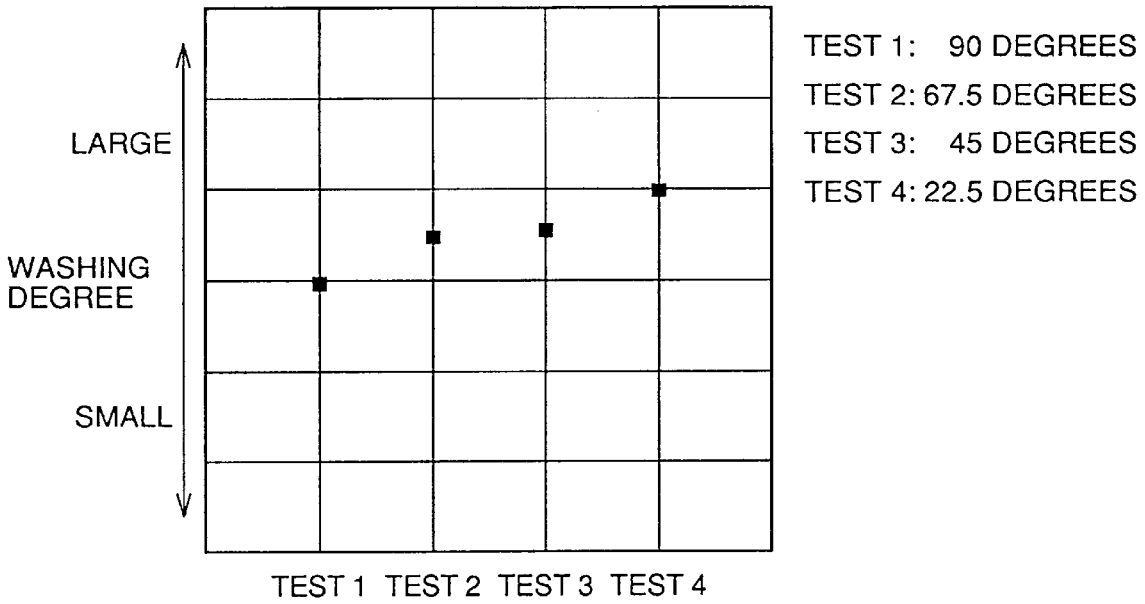
FIG. 5 illustrates the relation between an angle formed by a convex portion with a horizontal base line and an extent of washing in the first embodiment of the present invention.

The washing capability of the electric washing machine in the first embodiment varies according to angle θ (see FIG. 2) formed by convex portions 5 and the horizontal base line as described above. FIG. 5 shows the relation of a degree of washing and different angles θ. The degree of washing is proportional in the example shown in FIG. 5. That is, it is higher at an upper point and lower at a lower point on the ordinate in FIG. 5. As shown in FIG. 5, the larger the angle the θ becomes, the higher the degree of washing. Smaller angle θ brings about a lower washing degree. However, the washing degree does not so vary when angle θ is in the range of 45° to 67.5°.

When angle θ is larger, the washing degree is generally improved because friction between the laundry and the convex portions increases. At the same time, however, damage imposed on the laundry also exchanges. Therefore, angle θ is preferably in the range of 45° to 67.5°. Of course, angle θ may be out of this range, dependent on the usage.

Second Embodiment

Figure 6:
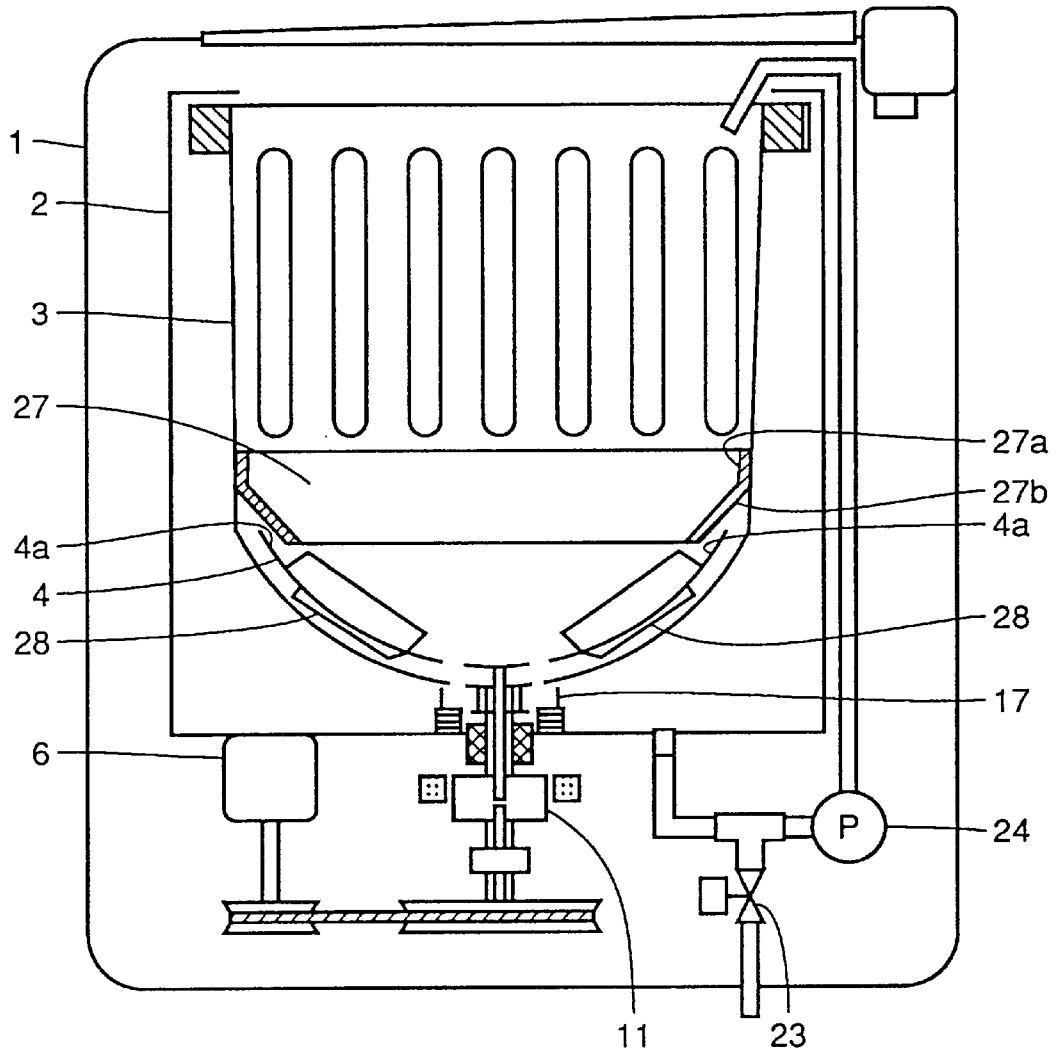
FIG. 6 is a front sectional view showing a schematic structure of an electric washing machine according to a second embodiment of the present invention.

Referring to FIG. 6, an electric washing machine according to a second embodiment of the present invention is the same as the electric washing machine according to the first embodiment shown in FIG. 1 except that a jamming preventing hopper 27 is newly provided. Jamming preventing hopper 27 serves to prevent the laundry from jamming in a gap between washing tank 3 and container type agitator 4. In FIG. 6, the same parts as the ones shown in FIG. 1 have the same reference characters and names. Therefore, their detailed descriptions will not be repeated here.

Referring to FIG. 6, jamming preventing hopper 27 is an annular frame body having a cross sectional shape of an almost inverted trapezoid. The planar shape of jamming preventing hopper 27 is circular as that of washing tank 3. The side surface of jamming preventing hopper 27 has an almost vertical upper portion 27*a* on its upper side and a lower oblique portion 27*b* on its lower side. At upper portion 27*a*, hopper 27 is attached to the inner surface of washing tank 3. The height of hopper 27 is selected so that the lowermost portion of lower oblique portion 27*b* is under the upper rim of agitator 4. An opening formed by the lowermost end of the lower oblique portions is inside agitator 4.

A plurality of abutting projections 4*a* are provided on the inner surface in the vicinity of the upper rim of agitator 4. Abutting projections 4*a* prevent plane contact between the lower surface of hopper 27 and the inner surface of agitator 4.

The operation of the electric washing machine according to the second embodiment is the same as that of the electric washing machine according to the first embodiment. In the second embodiment, hopper 27 prevents the laundry from jamming in the gap between agitator 4 and washing tank 3. During the washing process, the laundry may go upward along the inner wall of agitator 4 and move toward washing tank 3. Hopper 27 is effective in smoothly moving the laundry. Thus, the laundry can not enter the gap between agitator 4 and washing tank 3 from the gap between hopper 27 and agitator 4.

In the second embodiment, water between washing tank 3 and agitator 4 is pushed upward by water pressurizing blades 28 as agitator 4 rotates. The water is forcibly returned from the gap between agitator 4 and washing tank 3 through the gap between agitator 4 and hopper 27 to the inner portion of agitator 4. It can prevent the laundry or lint from jamming in the gap between agitator 4 and washing tank 3 as well as in the gap between agitator 4 and hopper 27.

Third Embodiment

Figure 7:
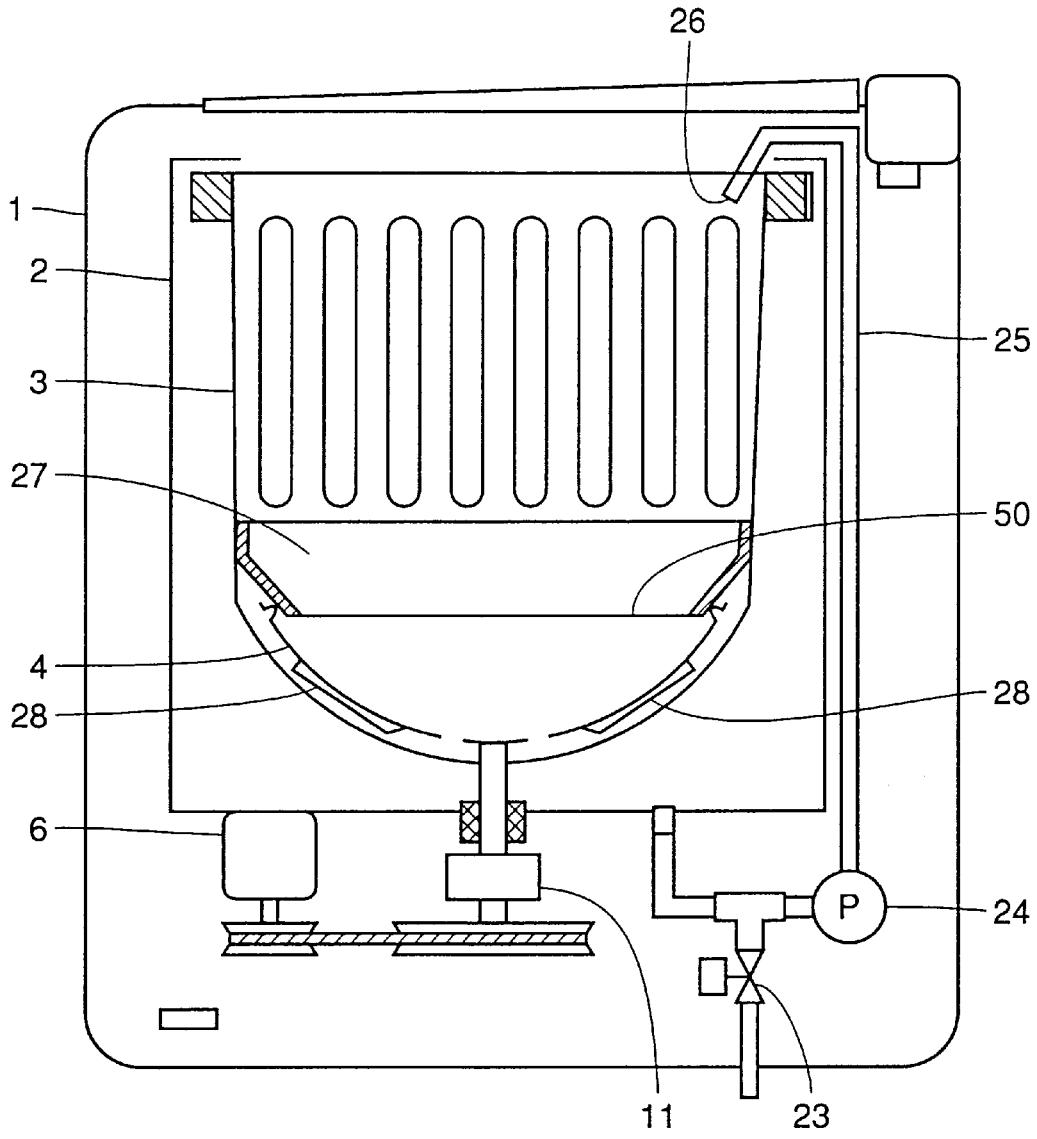
FIG. 7 is a front sectional view showing a schematic structure of an electric washing machine according to a third embodiment of the present invention.
Figure 8:
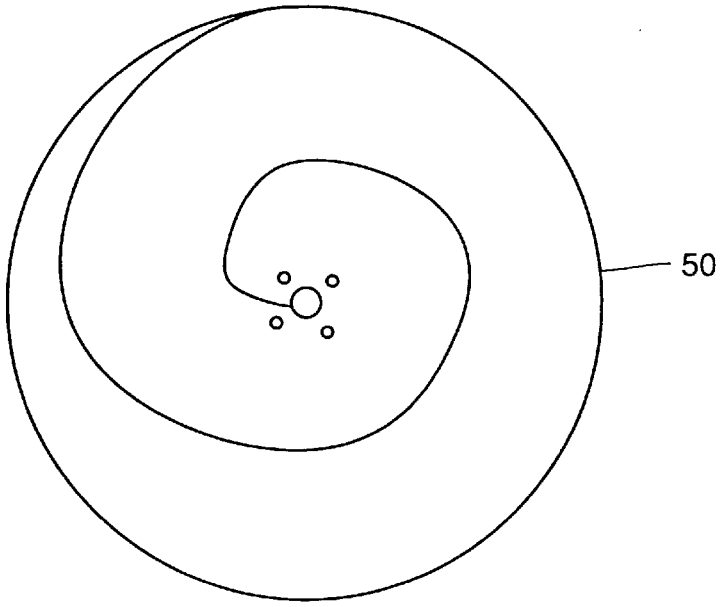
FIG. 8 is an enlarged plan view showing a shape of a convex portion which is formed on the inner surface of the container type agitator used in the electric washing machine in the third embodiment of the present invention.

Referring to FIGS. 7 and 8, an electric washing machine according to a third embodiment of the present invention is the same as the electric washing machine according to the second embodiment except that a spiral convex portion 50 is provided instead of convex portions 5 which are provided on the bottom surface of agitator 4. In FIGS. 7 and 8, the parts shown in FIGS. 1 or 6 have the same reference characters and names. Therefore, their detailed descriptions will not be repeated here.

Referring to FIGS. 7 and 8, convex portion 50 helps the laundry which exists inside agitator 4 to move along the spiral of convex portion 50 when agitator 4 rotates. Since convex portion 50 forms the spiral, the laundry is moved smoothly along convex portion 50. Agitation becomes smoother as compared with the washing machine according to the second embodiment, and thus damage to the laundry can be prevented. In addition, the washing capability can be improved.

Figure 9:
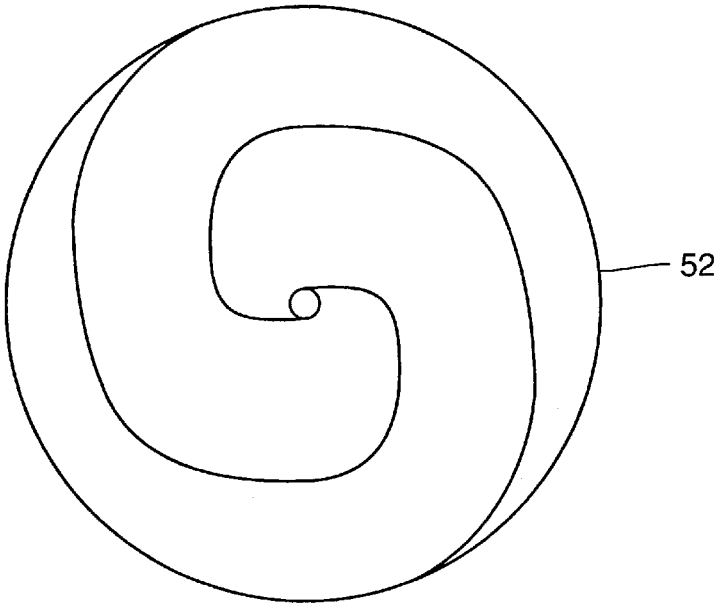
FIG. 9 is an enlarged plan view showing another shape of a plurality of convex portions which are formed on the inner surface of the container type agitator used in the electric washing machine in the third embodiment of the present invention.

Apparently, a plurality of convex portions 52 as shown in FIG. 9 may be used instead of convex portion 50.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electric washing machine, comprising:

a washing machine body;

a water tank having a bottom surface with an opening and fixed in said washing machine body;

a double-cylindrical axes body formed of outer and inner rotary axes passing through said opening of said water tank bottom surface;

a washing tank attached to an upper end of said outer rotary axis, arranged in said water tank, and having a large number of dehydration holes through a sidewall of said washing tank;

a container type agitator attached to an upper end of said inner rotary axis, arranged at a bottom of said washing tank, and having a shape which is open upward;

a planetary gear mechanism coupled to a lower end of said double-cylindrical axis body, said planetary gear mechanism including an input axis, a planetary gear outer periphery portion fixed to said outer rotary axis, and a group of planetary gears coupled to said inner rotary axis, engaging with an outer periphery of said input axis and an inner surface of said planetary gear outer periphery portion, and rotating in a group around said input axis;

an electric motor and power transmission mechanism for rotatably driving said input axis; and a brake arranged near an outer periphery of said planetary gear outer periphery portion, releasing said planetary gear outer periphery portion at least during washing, and clamping said planetary gear outer periphery portion during dehydration.

2. The electric washing machine according to claim 1, wherein said container type agitator has a liquid passing hole formed through its bottom.

3. The electric washing machine according to claim 2, further comprising a convex portion provided on a bottom surface of said container type agitator.

4. The electric washing machine according to claim 3, wherein said convex portion is formed spirally on the bottom surface of said container type agitator.

5. The electric washing machine according to claim 4, further comprising:

a jamming preventing hopper fixed in an inner surface of said washing tank immediately over on said container type agitator, wherein said hopper is formed of an annular frame body having a cross section of an almost inverted trapezoid which has an upper opening having an almost same size as a planer shape of said washing tank and a lower opening having a smaller size, and said hopper is fixed to the inner surface of said washing tank so that said lower opening is under an upper rim of said container type agitator.

6. The electric washing machine according to claim 5, further comprising a plurality of abutting projections arranged in a position opposed to an oblique side surface of said hopper near an upper rim of the bottom surface of said container type agitator.

7. The electric washing machine according to claim 6, further comprising a water pressurizing blade formed, on a lower surface of said container type agitator, having a size not interfering with a bottom surface of said washing tank.

8. The electric washing machine according to claim 5, further comprising a water pressuring blade formed, on a lower surface of said container type agitator, having a size not interfering with a bottom surface of said washing tank.

9. The electric washing machine according to claim 3, further comprising a jamming preventing hopper fixed in an inner surface of said washing tank immediately over on said container type agitator, wherein said hopper is formed of an annular frame body having a cross section of an almost inverted trapezoid which has an upper opening having an almost same size as a planar shape of said washing tank and a lower opening having a smaller size, and said hopper is fixed to the inner surface of said washing tank so that said lower opening is under an upper rim of said container type agitator.

10. The electric washing machine according to claim 9, further comprising a plurality of abutting projections arranged in a position opposed to an oblique side surface of said hopper near an upper rim of the bottom surface of said container type agitator.

11. The electric washing machine according to claim 1, further comprising a water pressuring blade formed, on a lower surface of said container type agitator, having a size not interfering with the bottom surface of said washing tank.

12. The electric washing machine according to claim 1, further comprising a water pressurizing blade formed, on a lower surface of said container type agitator, having a size not interfering with the bottom surface of said washing tank.

13. The electric washing machine according to claim 1, wherein a convex portion is located on a bottom surface of said container type agitator so that a longitudinal direction of said convex portion forms a prescribed angle other than zero with a horizontal surface.

14. The electric washing machine according to claim 13, further comprising a jamming preventing hopper fixed in an inner surface of said tank immediately over said container type agitator, wherein said hopper is formed of an annular frame body having a cross section of an almost inverted trapezoid which has an upper opening having an almost same size as a planar shape of said washing tank and a lower opening having a smaller size, and said hopper is fixed to the inner surface of said washing tank so that said lower opening is under an upper rim of said container type agitator.

15. The electric washing machine according to claim 14, further comprising a plurality of abutting projections arranged in a position opposed to an oblique side surface of said hopper near an upper rim of the bottom surface of said container type agitator.

16. The electric washing machine according to claim 15, further comprising a water pressurizing blade formed, on a lower surface of said container type agitator, having a size not interfering with a bottom surface of said washing tank.

17. The electric washing machine according to claim 14, further comprising a water pressurizing blade formed, on a lower surface of said container type agitator, having a size not interfering with a bottom surface of said washing tank.

18. The electric washing machine according to claim 1, further comprising a jamming preventing hopper fixed in an inner surface of said washing tank immediately over said container type agitator, wherein said hopper is formed of an annular frame body having a cross section of an almost inverted trapezoid which has an upper opening having an almost same size as a planar shape of said washing tank and a lower opening having a smaller size, and said hopper is fixed to the inner surface of said washing tank so that said lower opening is under an upper rim of said container type agitator.

19. The electric washing machine according to claim 18, further comprising a plurality of abutting projections arranged in a position opposed to an oblique side surface of said hopper near the upper rim of the bottom surface of said container type agitator.

20. The electric washing machine according to claim 19, further comprising a water pressurizing blade formed, on a lower surface of said container type agitator, having a size not interfering with a bottom surface of said washing tank.

* * * * *